US006116219A

United States Patent [19]

Girard

[11] Patent Number: 6,116,219

[45] Date of Patent: Sep. 12, 2000

[54] DEVICE FOR FIXING A FUEL INJECTOR ON AN INTERNAL COMBUSTION ENGINE CYLINDER HEAD

[75] Inventor: Didier Girard, Menucourt, France

[73] Assignees: Automobiles Peugeot, Paris; Automobiles Citroën, Neuilly sûr Seine, both of France

[21] Appl. No.: 09/194,201

[22] PCT Filed: Apr. 8, 1998

[86] PCT No.: PCT/FR98/00704

§ 371 Date: Mar. 31, 1999

§ 102(e) Date: Mar. 31, 1999

[87] PCT Pub. No.: WO98/45595

PCT Pub. Date: Oct. 15, 1998

[30] Foreign Application Priority Data

Apr. 10, 1997 [FR] France ..... 97 04382

[51] Int. Cl.[7] ..... F02M 55/02

[52] U.S. Cl. ..... 123/470

[58] Field of Search ..... 123/470, 472

[56] References Cited

U.S. PATENT DOCUMENTS

| | | | |
|---|---|---|---|
| 4,133,321 | 1/1979 | Hofmann et al. | 123/470 |
| 4,203,402 | 5/1980 | Freyn | 123/470 |
| 4,528,959 | 7/1985 | Hauser, Jr. | 123/470 |
| 4,589,596 | 5/1986 | Stumpp et al. | 123/470 |
| 6,009,856 | 1/2000 | Smith, III et al. | 123/470 |

FOREIGN PATENT DOCUMENTS

| | | |
|---|---|---|
| 0 735 267 | 10/1996 | European Pat. Off. . |
| 43 15 233A | 7/1994 | Germany . |

*Primary Examiner*—Thomas N. Moulis
*Attorney, Agent, or Firm*—Pollock Vande Sande & Amernick

[57] ABSTRACT

The invention concerns a device for fixing a fuel injector on an internal combustion engine cylinder head consisting of a part called bottom part (2*a*) for covering at least an engine cylinder and a part called top part (2*b*) defining with the other part a chamber (5) containing mechanical members for actuating valves. The injector (1) passes through these two parts and is supported on the base (8) of a well (4) of the bottom part (2*a*) by a flange (9) fixed to the cylinder head (13) with screws, and by means of a tubular piece (10) enclosing the injector body and resting on the projecting part of a lock ring (16) mounted in a peripheral groove (15) of the injector body. The invention is characterized in that, the flange (9) is rigidly integral with the tubular piece (10) fitted in a cylinder recess (14) of the top part (2*b*).

4 Claims, 2 Drawing Sheets

DEVICE FOR FIXING A FUEL INJECTOR ON AN INTERNAL COMBUSTION ENGINE CYLINDER HEAD

This invention is about a device to affix a fuel injector on the cylinder head of an internal combustion engine.

More particularly, the invention describes a device for an injector that goes through, nearly vertically, the cylinder head and exits it on an interior surface that covers the supposedly vertical cylinder of the engine, and exits it on an accessible exterior surface.

In an implementation known in patent DE43 15 233, the affixing device is integrated in the cylinder head, in a chamber that contains the mechanical elements that actuate the valves, and contains a cylindrical sleeve that surrounds the body of the injector.

This latter possesses, along its central section located in the chamber, a peripheral groove able to receive a trim on which the sleeve comes to rest on the bottom with the aid of an interior shoulder to immobilize the injector against the lower bottom of a housing designed in the cylinder head, generally called injector well.

The sleeve extends toward the bottom from the shoulder forming a recess that comes to tighten a protruding section of the cylinder head with interposition of circular seal inserted in order to protect the body of the injector from the oil cloud in the chamber. Between the top section of the sleeve and a cover of the cylinder head delimiting the chamber is set a lipped gasket to insure the seal between the chamber and the outside of the cylinder head.

The sleeve is attached in the cylinder head by a fork that rests on two exterior transversal wings of the sleeve under the pressure of a threaded part screwed in the cylinder head.

Such a device congests the chamber by reducing the space available for the valves and requires relatively costly seals; furthermore, the disassembly of the fuel injector is difficult and a precarious balance above its attachment is detrimental to its reliability.

It is this invention's aim to show a device of the type described below that remedies the problems mentioned above.

In effect, the invention is about a device for affixing a fuel injector to an internal combustion engine cylinder head that consists of a bottom part designed to cover an engine cylinder and a top part, which defines with the other part a chamber that contains mechanical valve actuators. The injector passes through these two parts and is supported at the base of a well of the bottom part by a flange attached to the cylinder head with screws, and by means of a tubular piece that enclosed the body of the injector and rests on the protruding section of a trim ring mounted in a peripheral groove in the injector body, characterized in that the flange is rigidly integrated with the tubular piece, made of a sleeve, which is inserted in a cylindrical hollow of the top part.

According to a few interesting designs of the invention:

- The sleeve is designed with a bore in which the body of the injector is inserted and of a peripheral groove in which is mounted a sealing gasket.
- The trim is made of a split ring with complementarily shaped extremities designed to seal the body of the injector to the bore of the sleeve when said sleeve comes to rest against the trim under the pressure of the flange that is attached to the head gasket.
- The sleeve contains, on it lower section, a circular base with beveled edges designed to insure the contact of the trim's extremities.

The characteristics of the invention mentioned above, as well as others, will appear more clearly during the reading of the following description of an implementation example, referring to the drawings in the appendix on which:

Figure 2:
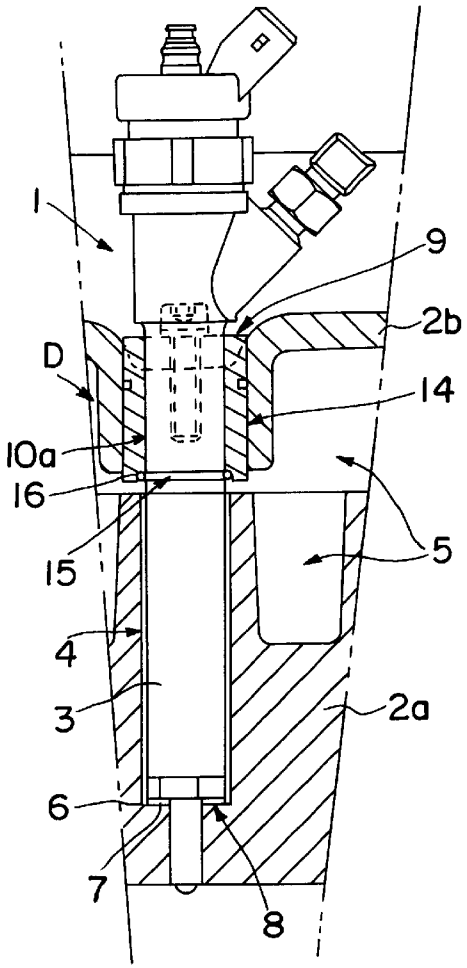
FIG. 2 is a partial cut view that follows line II—II in FIG. 1.
Figure 1:
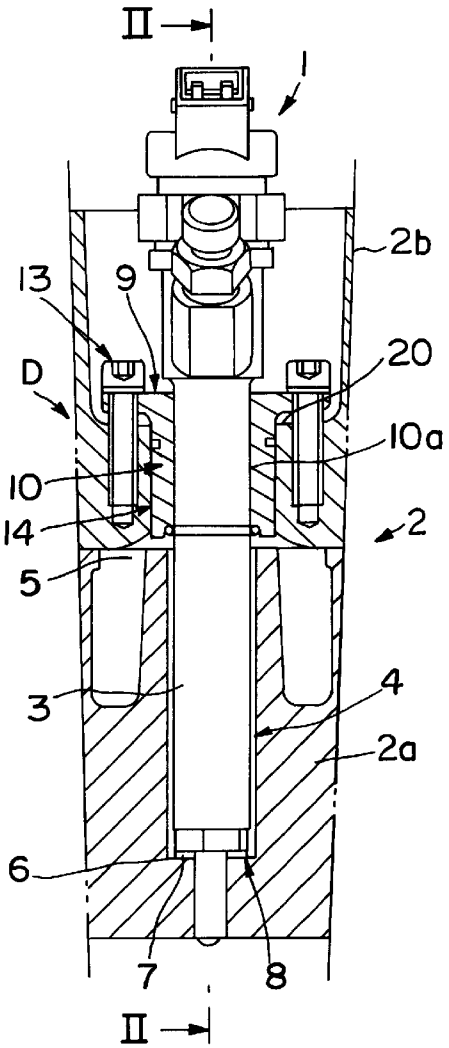
FIG. 1 is a partial, longitudinal cut view of the invention's device to affix a fuel injector on the head cylinder of an internal combustion engine.

We can see, on FIGS. 1 and 2, a fuel injector 1 passing through a head cylinder 2 of a internal combustion engine and maintained on it by an attachment device D.

The head cylinder 2 contains on one hand a section called the bottom part 2*a* that is designed to cover at least one engine cylinder, here supposed vertical, and on the other hand a section called top part 2*b* forming a cylinder head cover and a superior half-landing for at least one crankshaft, not shown, interposed between the two parts 2*a*and 2*b*, that delimit between themselves a chamber 5 that contains valve command mechanisms.

The injector 1 is made of a generally cylindrical body of which lower section 3 is lodged in a hollow 4 called a well that is set in the bottom section 2*a* of the cylinder head and exits this section into chamber 5.

This latter is filled, during engine operation, of a cloud mist of oil that lubricates moving parts.

The body of the injector 1 possesses in its lower section a radial shoulder 6 that rests, in the classic way, against the bottom 8 of the well 4. A copper washer 7 is used between these elements as a seal.

According to this invention, the injector 1 is attached to the top section 2*b* of the cylinder head with the aid of a attachment flange 9 that is made of a cylindrical sleeve 10 that has a bore 10*a*.

Figure 6:
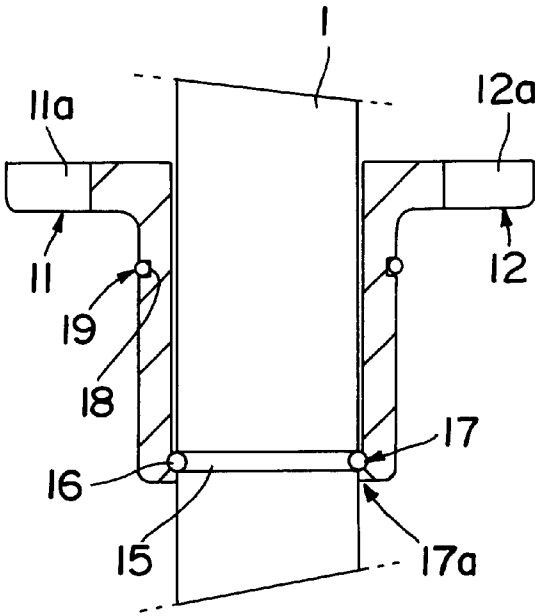
FIG. 6 is a cut view, to a greater scale, following line VI—VI of FIG. 4
Figure 4:
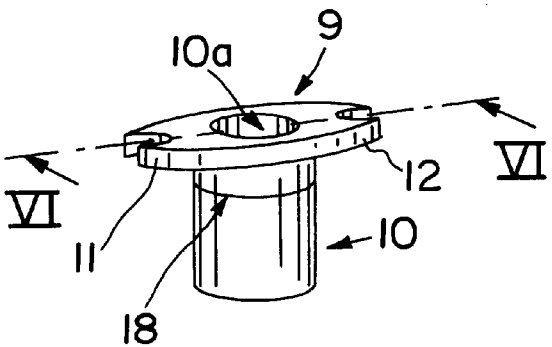
FIG. 4 shows a perspective view of a flange of the device.

The sleeve 10 contains, on its upper section, as shown on FIGS. 4 and 6, two transversal symmetrical wings 11 and 12 which each contain a shaft, respectively 11*a* and 12*a*, that allows the passage of an attachment screw 13.

This sleeve 10 is inserted in a cylindrical housing 14 designed in the top section 2*b* and is affixed to it by the attachment screws 13.

The body of the injector 1 contains, in its central section, located above the bottom part 2*a* of the cylinder head, a peripheral groove 15 in which is mounted a trim 16 made of pliant metal that partially protrudes from the groove 15 thus forming a circular support area for the flange 9.

Figure 5:
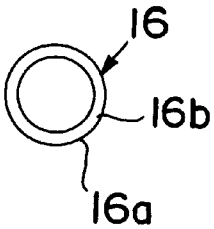
FIG. 5 is a top view of a trim of the device.
Figure 3:
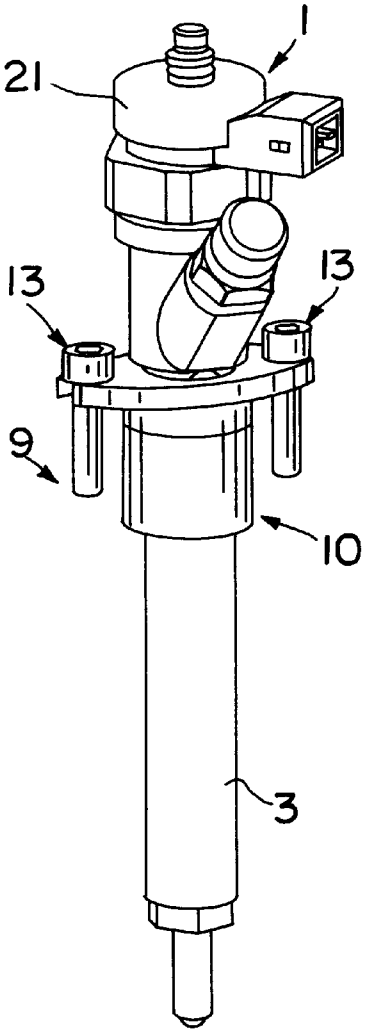
FIG. 3 is a perspective view of the injector and of a part of the affixing device.

The trim 16, shown on FIG. 5, is made of a split ring with extremities 16*a*, 16*b* whose complementary shapes are designed to insure a good seal when they are joined.

The sleeve 10 contains, on its lower end, a circular base 17 that sits on the protruding part of the trim 16. This support base 17 contains a beveled edge 17*a* in order to insure a complete contact along the protruding part of the trim and to bring the trim's extremities together as it exerts an axial pressure against this trim.

The exterior diameter of the sleeve 10 has a peripheral groove in which is installed a sealing ring gasket 19.

The affixing of an injector 1 on the cylinder head 2 with the aid of the flange 9 is performed in the following manner, the two parts 2*a* and 2*b* of the cylinder head being already assembled.

During the first step, the operator inserts the body of the injector in the bore 10*a* of the flange 9 then sets the trim 16 in the peripheral groove 15.

The operator then inserts the lower section of the injector body in the hollow 4 of the bottom part 2*a* of the cylinder head, also inserting the flange 9 and the associated seal gasket 19 in the housing 14 of the top part 2*b*.

Finally, flange 9 is attached to the top part 2*b* by attachment screws 13 whose tightening forces the flange toward the bottom against the trim 16, thus upon the injector 1 until its lower section rests on the bottom 8 of the well 4. This force produces the contact and sealing of the two trim extremities.

Please note that the wings 11 and 12 of the flange 9 are spaced from the outside surface 20 of the top part 2*b*, to allows a play for the screws 13 because of the different thermal dilations of the injector and of the cylinder head.

Such a device according to the invention has the advantage of reducing the crowding in chamber 5 around the injector and to insure a good seal of chamber 5 (which contains the oil cloud), while being simple to implement and of slight cost.

Furthermore, this implementation allows, through the sleeve of the flange, a stable support of the injector near its head 21 and thus of its associated structures, thus reducing the common upper precarious balance that harms the injector's reliability.

What is claimed is:

1. A device for attaching a fuel injector to an internal combustion engine cylinder head that consists of a bottom part (2*a*) designed to cover at least one engine cylinder and a top part (2*b*), which defines with said bottom part a chamber (5) that contains mechanical valve actuators, the injector (1) passing through said top and bottom parts and being supported at the base (8) of a well (4) of the bottom part (2*a*) by a flange (9) attached to the cylinder head with screws (13), and by means of a tubular piece (10) that encloses the body of the injector and rests on the protruding section of a trim ring (16) mounted in a peripheral groove (15) in the injector body, wherein the flange (9) is rigidly integrated with the tubular piece, made of a sleeve (10), which is inserted in a cylindrical hollow (14) of the top part (2*b*).

2. The attachment device according claim 1, wherein the sleeve (10) contains a bore (10*a*) in which is inserted the body of the injector (1) and a peripheral groove (18) in which is mounted the sealing gasket (19).

3. The attachment device according to claim 1, wherein the trim ring (16) is made of a split ring whose ends (16*a*, 16*b*) complement each other in order to insure a proper seal between the body of the injector and the bore of the sleeve when said sleeve (10) is pressed against the trim when the flange (19) is attached to the head cylinder.

4. The attachment device according to claim 3, wherein a lower part of the sleeve (10) contains a circular base (17) with beveled edges (17*a*) designed to insure the coming together of the ends of the trim ring.

* * * * *